US007526903B2

(12) United States Patent
Kandasamy

(10) Patent No.: US 7,526,903 B2
(45) Date of Patent: May 5, 2009

(54) THERMAL BREAK AND PANEL JOINT FOR AN AIR HANDLING ENCLOSURE

(75) Inventor: Ganeson Kandasamy, Lexington, KY (US)

(73) Assignee: Trane International Inc., Piscataway, NJ (US)

( * ) Notice: Subject to any disclaimer, the term of this patent is extended or adjusted under 35 U.S.C. 154(b) by 601 days.

(21) Appl. No.: 11/315,739

(22) Filed: Dec. 21, 2005

(65) Prior Publication Data

US 2007/0151169 A1 Jul. 5, 2007

(51) Int. Cl.
*E04C 2/00* (2006.01)
*E04B 2/00* (2006.01)

(52) U.S. Cl. ..... 52/782.1; 52/588.1

(58) Field of Classification Search ..... 52/79.1, 52/782.1, 784.13, 309.9, 588.1
See application file for complete search history.

(56) References Cited

U.S. PATENT DOCUMENTS 2,647,287 A 8/1953 Jones
3,461,633 A * 8/1969 Ziegelman et al. ..... 52/643
3,782,495 A * 1/1974 Nassof ..... 181/284
4,183,393 A * 1/1980 Bailey ..... 160/232
4,436,136 A * 3/1984 Downey, Jr. ..... 160/232
4,438,614 A * 3/1984 Raith et al. ..... 52/580
4,596,094 A * 6/1986 Teller et al. ..... 52/98
4,769,963 A * 9/1988 Meyerson ..... 52/309.9
4,854,365 A * 8/1989 Juneau ..... 160/232
5,293,728 A * 3/1994 Christopher et al. ..... 52/588.1
5,404,686 A * 4/1995 Esposito ..... 52/588.1
5,448,865 A * 9/1995 Palmersten ..... 52/309.9
5,502,939 A * 4/1996 Zadok et al. ..... 52/309.9
5,533,312 A * 7/1996 Mihalcheon ..... 52/309.9
5,560,150 A * 10/1996 Pearson ..... 52/79.14
5,613,338 A * 3/1997 Esposito ..... 52/588.1
5,647,184 A * 7/1997 Davis ..... 52/592.1
5,711,706 A 1/1998 Griffin et al.
5,819,491 A * 10/1998 Davis ..... 52/592.1
6,096,416 A * 8/2000 Altenberg ..... 428/317.7
6,122,879 A * 9/2000 Montes ..... 52/592.1
6,256,959 B1 * 7/2001 Palmersten ..... 52/588.1
6,279,287 B1 * 8/2001 Meadows ..... 52/589.1

(Continued)

FOREIGN PATENT DOCUMENTS

WO WO 94/24493 10/1994

OTHER PUBLICATIONS

Trane Custom Class "B" Thermal Break, Wall to Roof Casing Detail, Drawing Name: 19a.dwg, Dated Apr. 18, 2005.

(Continued)

*Primary Examiner*—Richard E Chilcot, Jr.
*Assistant Examiner*—Andrew J Triggs
(74) *Attorney, Agent, or Firm*—William O'Driscoll

(57) ABSTRACT

An HVAC air handling enclosure is comprised of individual panel assemblies each of which are fabricated from two panels or skins that are held together by double-sided adhesive tape. Adjacent panel assemblies are connected by a metal tongue-and-groove joint that relies on that same tape as a thermal break at the joint. After assembly, the thermal break and the tongue and groove elements of the joint are completely hidden from view. Moreover, the joint includes an internal cavity that can take up surplus sealant that may ooze out from within the tongue-and-groove joint during assembly, whereby the surplus sealant also remains hidden.

14 Claims, 2 Drawing Sheets

U.S. PATENT DOCUMENTS

| | | | | |
|---|---|---|---|---|
| 6,311,456 | B1 * | 11/2001 | Rodero Antunez | 52/794.1 |
| 6,314,701 | B1 * | 11/2001 | Meyerson | 52/588.1 |
| 6,335,074 | B1 * | 1/2002 | Gasteyer et al. | 428/76 |
| 6,345,511 | B1 * | 2/2002 | Esty et al. | 62/259.1 |
| 6,374,571 | B1 | 4/2002 | Mann | |
| 6,418,686 | B1 * | 7/2002 | Record | 52/309.15 |
| 6,584,740 | B2 * | 7/2003 | Record | 52/270 |
| 6,586,085 | B1 * | 7/2003 | Jella | 428/319.1 |
| 6,676,234 | B2 | 1/2004 | Herbeck et al. | |
| 6,703,331 | B1 * | 3/2004 | Bruce et al. | 442/386 |
| 6,769,217 | B2 * | 8/2004 | Nelson | 52/582.1 |
| 6,974,383 | B2 * | 12/2005 | Lewis et al. | 454/338 |
| 7,003,924 | B2 * | 2/2006 | Kettler et al. | 52/578 |
| 7,146,772 | B2 * | 12/2006 | Ralf | 52/592.1 |
| 7,338,400 | B2 * | 3/2008 | Pierjok et al. | 474/115 |
| 2002/0189183 | A1 * | 12/2002 | Ricciardelli | 52/390 |
| 2003/0037502 | A1 * | 2/2003 | Bruce et al. | 52/517 |
| 2003/0110730 | A1 * | 6/2003 | Vos | 52/588.1 |
| 2004/0118056 | A1 * | 6/2004 | Peters et al. | 52/79.1 |
| 2005/0055919 | A1 * | 3/2005 | Dubensky et al. | 52/302.1 |
| 2006/0283657 | A1 * | 12/2006 | Dubensky et al. | 181/200 |
| 2007/0068110 | A1 * | 3/2007 | Liu | 52/588.1 |

OTHER PUBLICATIONS

Trane Custom Class "B" Thermal Break, Wall Corner Seam Casing Detail, Drawing Name: 18.dwg, Dated Apr. 15, 2005.

Trane Custom Class "B" Thermal Break, Wall Seam Casing Detail, Drawing Name: 16.dwg, Dated Apr. 13, 2005.

* cited by examiner

THERMAL BREAK AND PANEL JOINT FOR AN AIR HANDLING ENCLOSURE

BACKGROUND OF THE INVENTION

1. Field of the Invention

The subject invention generally pertains to HVAC air handling enclosures and more specifically to a thermal break and panel joint for such an enclosure.

2. Description of Related Art

Heat exchangers, compressors, blowers, filters and other HVAC equipment are often housed within an air handling enclosure. The enclosure helps shelter the equipment, provides a sound barrier, and perhaps most importantly, the enclosure provides a conduit for directing the air through the equipment. Air handling enclosures usually comprise a number of sheet metal panels that are interconnected to create a box-like structure.

In many cases, the panels are insulated to minimize heat loss between the interior and exterior of the enclosure. Although such insulation can improve the operating efficiency of the air handling system, some localized heat loss may still occur at the uninsulated metal-to-metal joint where two panels come together. Such localized heat loss may be inconsequential to the system's overall efficiency; however, when there is a significant temperature differential between the interior and exterior of the enclosure, condensation may form on the joint. The condensation can lead to poor air quality, water damage or create a wet, slippery floor around the enclosure. In some cases, the condensation may freeze, and the accumulating frost can provide a poor appearance or prevent doors or other moving parts of the enclosure from operating.

Some enclosures have a non-metallic seal that lines one or more edges of each panel. Examples of such seals are disclosed in publication WO 94/24493 and U.S. Pat. Nos. 6,676,234 and 2,647,287. These seals, however, are visible and may be exposed to sunlight whose ultraviolet radiation may hasten their deterioration. Moreover, some consider exposed seals unsightly. U.S. Pat. No. 6,374,571 shows how a panel with a hidden seal can be attached to a frame member, but then, of course, the enclosure requires a frame, which adds cost to the enclosure.

Consequently, a need exists for providing an air handling enclosure with insulated panels and a hidden thermal break at the joints without having to add a frame to help support the panels.

SUMMARY OF THE INVENTION

It is an object of the present invention to provide an air handling enclosure with self-supporting insulated panels that include a hidden thermal break at the joints.

Another object of some embodiments is to provide a seal that serves as both a thermal break and a fastener for holding a panel's inner and outer skins together.

Another object of some embodiments is to use double-sided tape that serves as both a thermal break and a fastener for holding a panel's inner and outer skins together.

Another object of some embodiments is to provide a thermal break for a joint that connects two panels end-to-end in direct contact with each other (i.e., in metal-to-metal contact with the exception of an inconsequential layer of paint or some other relatively thin coating).

Another object of some embodiments is to provide a panel with an edge that lies at a slight acute angle to the face of the panel so that when the edge abuts a similar edge of an adjoining panel, the two panels close any visible gap that might otherwise exist.

Another object of some embodiments is to connect two panels with a solid metal-to-metal tongue-and-groove joint, and yet provide that solid joint with a thermal break.

Another object of some embodiments is to connect two adjoining panels with tongue-and-groove joint that allows a sealing compound to be introduced deeply inside the groove. If any compound oozes out from within the groove, the slightly angled edges of the panels create a cavity to take up any excess compound so that the entire sealing compound preferably remains hidden between the joint.

Another object of some embodiments is to connect two panels with a tongue-and-groove joint, wherein the tongue and groove are formed as an integral extension of the panel sheets that provide the outer faces of each panel, thereby minimizing the number of parts and maximizing the panels' strength.

Another object of some embodiments is to provide a panel assembly with one tape held in compression and one held in tension, whereby the opposing forces provide a tight resilient connection within a tongue-and-groove joint.

One or more of these and/or other objects of the invention are provided by an air handling enclosure whose individual panel assemblies are taped together, and adjacent panel assemblies are connected by a tongue-and-groove joint that relies on that same tape as a thermal break at the joint.

DESCRIPTION OF THE PREFERRED EMBODIMENT

Figure 1:
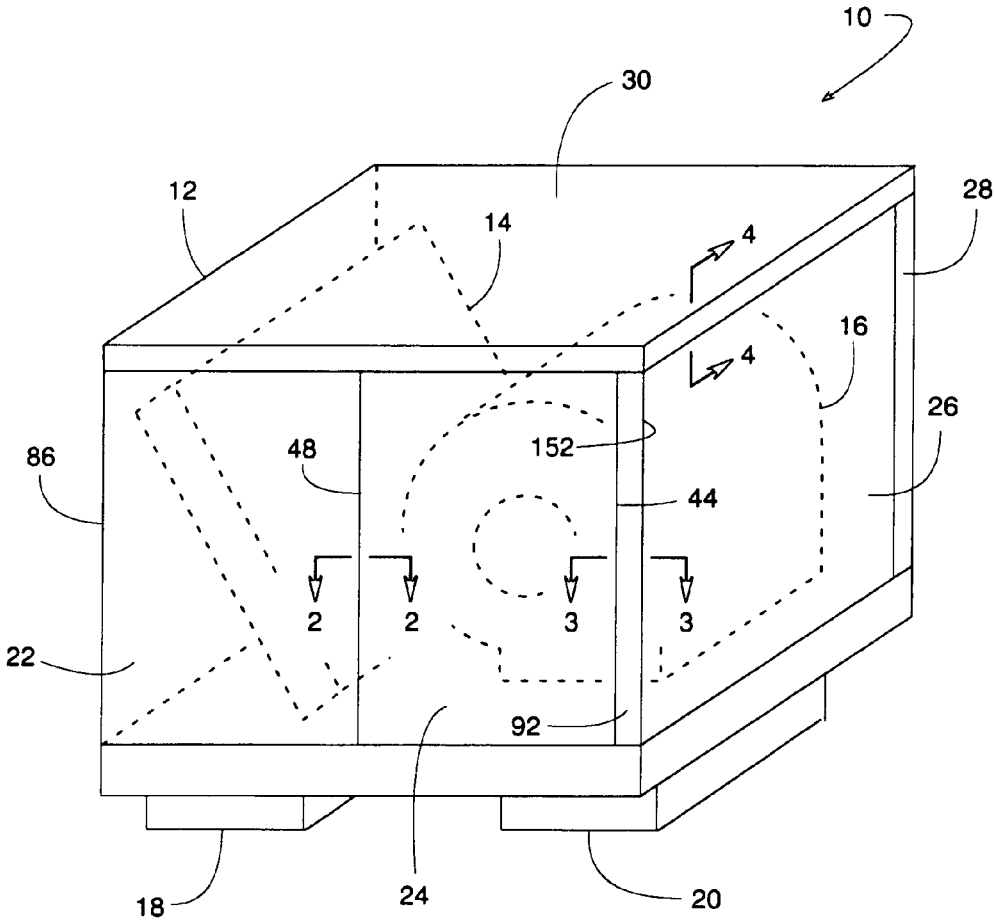
FIG. 1 is a perspective view of an air handling enclosure.

FIG. 1 shows an air handler 10 comprising an enclosure 12 that contains a heat exchanger 14, a blower 16, compressor, filter, or some other type of HVAC equipment. Enclosure 12 is open to an inlet 18 and an outlet 20 for conveying air across the equipment housed within the enclosure. The equipment inside enclosure 12 is used in some manner to handle or condition air associated with an HVAC system. Since a temperature differential usually exists between the enclosure's interior and exterior, enclosure 12 is preferably insulated.

Enclosure 12 can be made of any number of insulated panel assemblies 22, 24,26, 28, and 30 that have a thermal insulating core sandwiched between inner and outer panel sheets. The inner and outer panel sheets are held together with double-sided tape. The tape also provides a thermal break where adjoining panel assemblies come together at a tongue-and-groove joint. Details of some embodiments of assemblies 22, 24, 26, 28, and 30 are shown in FIGS. 2-4.

Figure 2:
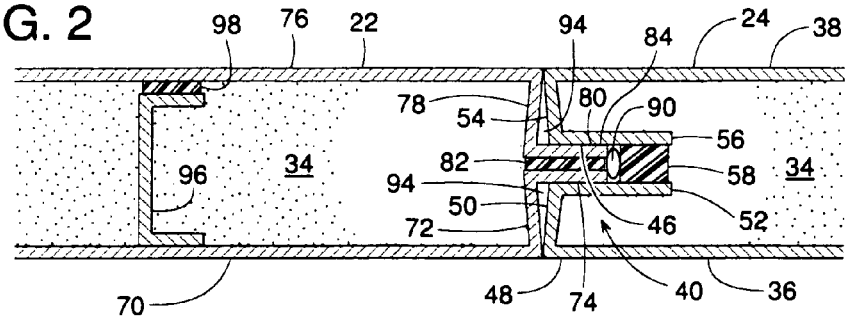
FIG. 2 is a cross-sectional view taken along line 2-2 of FIG. 1.
Figure 3:
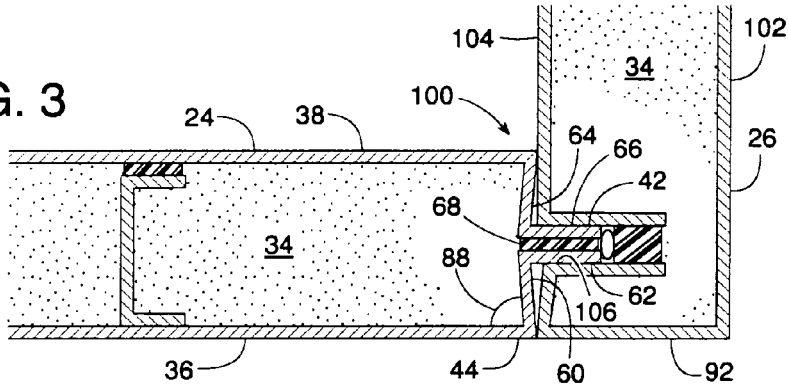
FIG. 3 is a cross-sectional view taken along line 3-3 of FIG. 1.
Figure 4:
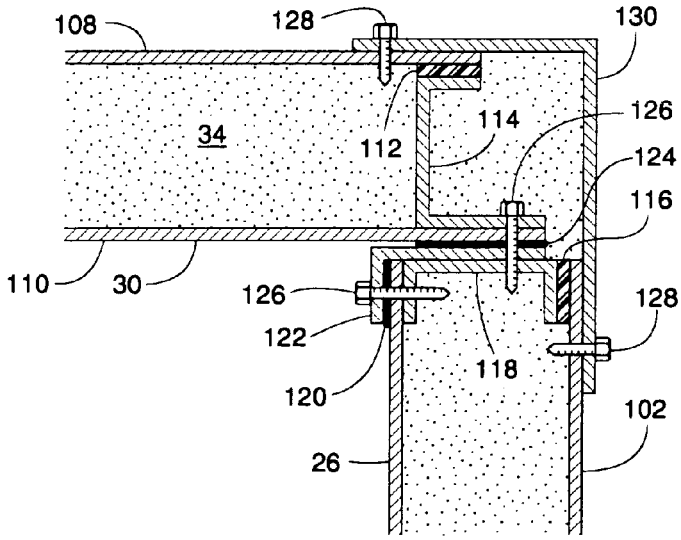
FIG. 4 is a cross-sectional view taken along line 4-4 of FIG. 1.

Referring to the right side of FIG. 2 and the left side of FIG. 3, panel assembly 24 comprises a thermal insulating core 34 between an outer panel 36 and an inner panel 38, wherein panels 36 and 38 are both made of sheet metal and are taped together. Examples of thermal insulating core 34 include, but are not limited to, foam injected between panels 36 and 38, or conventional fiberglass. To interconnect any number of panels assemblies end-to-end using a tongue-and-groove joint 40, panels 36 and 38 are formed to create a tongue 42 at one end 44 (FIG. 3) and a mating groove 46 at an opposite end 48 (FIG. 2).

At end 48 (FIG. 2), outer panel 36 is formed from a single piece of sheet metal to create an outer groove edge 50 that leads to an outer groove flange 52. Likewise, inner panel 38 is formed to create an inner groove edge 54 that leads to an inner groove flange 56. A strip of double-sided tape 58 (i.e., adhesive on both sides) holds flanges 52 and 56 in a generally fixed spaced-apart relationship to create groove 46. Although various types of tape could be used, in a currently preferred embodiment, tape 58 is 0.25" thick by 0.5" wide (e.g., P/N DKARS119 by Duraco, Inc. of Forest Park, Ill.).

At end 44 of panel assembly 24 (FIG. 3), outer panel 36 is formed to create an outer tongue edge 60 and an outer tongue flange 62. Likewise, inner panel 38 is formed to create an inner tongue edge 64 and an inner tongue flange 66. Another strip of double-sided tape 68 holds flanges 62 and 66 together to create tongue 42. In this case, tape 68 is 0.125" thick by 0.75" wide (e.g., Duraco P/N DKAR150).

Panel assembly 22 is similar to panel assembly 24 in that assembly 22 comprises an outer panel 70, an outer tongue edge 72, an outer tongue flange 74, an inner panel 76, an inner tongue edge 78, an inner tongue flange 80, insulating core 34, and a strip of double-sided tape 82 that bonds inner tongue flange 80 to outer tongue flange 74 to create a tongue 84. An opposite end 86 of panel assembly 22 could be similar to an end 92 of panel assembly 26, or in some cases, end 86 could be similar to end 48. For strength and ease of manufacture, the inner panels and their metal tongue and groove elements are formed from a unitary piece of sheet metal. The same is true for the outer panels. For panel assembly 24, for example, outer panel 36, outer groove edge 50, outer groove flange 52, outer tongue edge 60, and outer tongue flange 62 comprise a unitary piece.

To connect panel assemblies 22 and 24 together, an adhesive sealant 90 is injected into the base of groove 46 prior to inserting tongue 84 of panel assembly 22 into groove 46 of panel assembly 24. Sealant 90 not only provides an effective seal at joint 40, but the adhesive properties of sealant 90 helps hold panel assemblies 22 and 24 together. A variety of adhesive sealants could be used, but in a currently preferred embodiment, sealant 90 is a 221-Sikaflex sealant provided by Sika Corporation of Baar, Switzerland (with various branch locations including Lyndhurst, N.J.).

To provide a clean, attractive joint, edges 50, 54, 72 and 78 each lie at a slightly acute angle 88 to its respective panel 36, 38, 70 and 76. Angle 88 is between 80 and 90 degrees and is preferably about 88-degrees. Angle 88 ensures that the two adjoining outer panels 36 and 70, and the two adjoining inner panels 38 and 76 come in direct contact with each other at the surface where panel assemblies 22 and 24 are most visible. Angle 88 also creates a gap 94 between edges 50 and 72, and between edges 54 and 78. Gap 94 provides a space into which surplus sealant 90 can ooze without being noticeable once enclosure 12 is assembled.

It should be noted that although tape strips 58, 68, and 82 couple inner panels 38 and 76 to outer panels 36 and 70, the tape strips also provide a thermal break between the inner and outer panels, as strips 58, 68, and 82 have a much lower thermal conductivity than the sheet metal material of the panels. To provide a resiliently tight fit at the tongue-and-groove joint 40, tape 58 is in tension, and tape 82 is in compression. If a metal stiffener 96 is added between the inner and outer panels, a strip of double-sided tape 98 can provide a thermal break for that as well.

FIG. 3 shows how a joint 100 similar to joint 40 can be used to join two panel assemblies 24 and 26 at a vertical corner of enclosure 12. Panel assembly 26 comprises an outer panel 102 and an inner panel 104 that are formed to create a groove 106 similar to groove 46. Panel assemblies 24 and 26 can then be joined by simply inserting tongue 42 into groove 106.

FIG. 4 shows how upper panel assembly 30 can be attached to a side panel assembly, such as panel assembly 26. Upper panel assembly 30 can be comprised of a series of interconnected panels, similar to the way panels 22 and 24 are interconnected to make one complete side of enclosure 12, or upper panel assembly 30 can simply comprise just one outer panel 108 attached to an inner panel 110. A tape strip 112 bonds an end cap 114 (similar or identical to stiffener 96) to outer panel 108. Likewise, a tape strip 116 bonds an end cap 118 to outer panel 102 of side panel assembly 26. A fastener 126 (e.g., sheet metal screw, or screw that is self-drilling and self-tapping) can be used for attaching an angle member 122 to side panel assembly 26 with a sealant 120 between the two. In some embodiments, sealant 120 comes as strip of moldable material that flows upon being compressed between two parts. One example of sealant 120 is SikaLastomer-95 provided by Sika Corporation of Baar, Switzerland (with various branch locations including Madison Heights, Mich.). Another screw 126 can fasten upper panel assembly 30 to angle member 122 and end cap 118. A sealant 124, similar or identical to sealant 120, can be pressed between assembly 30 and angle 122. Screws 128, similar or identical to screws 126, can fasten an angle member 130 to cover the joint. Tape strips 112 and 124 serve as fasteners and thermal breaks. Screws 126 and sealant strips 120 and 124 prevent air bypass at the upper joints.

Although the invention is described with respect to a preferred embodiment, modifications thereto will be apparent to those of ordinary skill in the art. Therefore, the scope of the invention is to be determined by reference to the following claims.

The invention claimed is:

1. An enclosure for HVAC equipment, wherein the enclosure has a tongue-and-groove joint the enclosure comprising:
- a first outer panel;
- an outer groove flange;
- an outer groove edge extending between the first outer panel and the outer groove flange;
- a first inner panel;
- an inner groove flange;
- an inner groove edge extending between the first inner panel and the inner groove flange;
- a first strip of tape joining the outer groove flange and the inner groove flange such that the outer groove flange and the inner groove flange define a groove therebetween;
- a second outer panel;
- an outer tongue flange;
- an outer tongue edge extending between the second outer panel and the outer tongue flange;
- a second inner panel;
- an inner tongue flange;
- an inner tongue edge extending between the second inner panel and the inner tongue flange; and
- a second strip of tape joining the outer tongue flange and the inner tongue flange to provide a tongue that is disposed within the groove.

2. The enclosure of claim 1, wherein the first outer panel and the outer groove flange is a first unitary piece, the first inner panel and the inner groove flange is a second unitary piece, the second outer panel and the outer tongue flange is a third unitary piece, and the second inner panel and the inner tongue flange is a fourth unitary piece.

3. The enclosure of claim 1, wherein the first outer panel and the second outer panel abut each other in direct contact.

4. The enclosure of claim 1, wherein the first strip of tape and the second strip of tape each have adhesive on both sides thereof.

5. The enclosure of claim 1, wherein the first strip of tape helps hold the first inner panel and the first outer panel together.

6. The enclosure of claim 1, wherein the second strip of tape helps hold the second inner panel and the second outer panel together.

7. The enclosure of claim 1, wherein the first strip of tape is held in tension between the outer groove flange and the inner groove flange.

8. The enclosure of claim 1, wherein the second strip of tape is held in compression between the outer tongue flange and the inner tongue flange.

9. The enclosure of claim 1, wherein the first outer panel and the outer groove edge define an acute angle.

10. The enclosure of claim 9, wherein the acute angle is greater than 80-degrees.

11. The enclosure of claim 1, wherein the second outer panel and the outer tongue edge define an acute angle.

12. The enclosure of claim 11, wherein the acute angle is greater than 80-degrees.

13. The enclosure of claim 1, further comprising a sealant bonding the first outer panel to the second outer panel.

14. The enclosure of claim 1, further comprising a first insulating core interposed between the first outer panel and the first inner panel; and a second insulating core interposed between the second outer panel and the second inner panel.

* * * * *